US007744462B2

(12) United States Patent
Grav et al.

(10) Patent No.: US 7,744,462 B2
(45) Date of Patent: Jun. 29, 2010

(54) TIERED PROGRESSIVE GAMING SYSTEM

(75) Inventors: Ted Grav, Vancouver (CA); James MacIntosh, Delta (CA)

(73) Assignee: Rocket Gaming Systems, LLC, Grove, OK (US)

( * ) Notice: Subject to any disclaimer, the term of this patent is extended or adjusted under 35 U.S.C. 154(b) by 371 days.

(21) Appl. No.: 11/139,998

(22) Filed: May 27, 2005

(65) Prior Publication Data

US 2006/0287077 A1 Dec. 21, 2006

(51) Int. Cl.
*A63F 9/00* (2006.01)

(52) U.S. Cl. ..... 463/27; 463/42

(58) Field of Classification Search ..... 463/27
See application file for complete search history.

(56) References Cited

U.S. PATENT DOCUMENTS

| | | | | |
|---|---|---|---|---|
| 5,116,055 | A | 5/1992 | Tracy | |
| 5,564,700 | A | 10/1996 | Celona | |
| 5,833,540 | A * | 11/1998 | Miodunski et al. | 463/42 |
| 6,146,273 | A | 11/2000 | Olsen | |
| 6,155,927 | A * | 12/2000 | Levasseur et al. | 463/42 |
| 6,325,375 | B1 | 12/2001 | Potter et al. | |
| 6,488,580 | B1 * | 12/2002 | Robb | 463/23 |
| 6,599,188 | B2 | 7/2003 | Hirsch et al. | |
| 6,887,154 | B1 * | 5/2005 | Luciano et al. | 463/26 |
| 6,939,234 | B2 * | 9/2005 | Beatty | 463/42 |
| 2001/0003714 | A1 * | 6/2001 | Takata et al. | 463/40 |
| 2002/0055381 | A1 * | 5/2002 | Tarantino | 463/20 |
| 2002/0151366 | A1 * | 10/2002 | Walker et al. | 463/42 |
| 2003/0171149 | A1 * | 9/2003 | Rothschild | 463/42 |
| 2003/0232650 | A1 * | 12/2003 | Beatty | 463/42 |
| 2004/0166940 | A1 * | 8/2004 | Rothschild | 463/42 |
| 2005/0096130 | A1 * | 5/2005 | Mullins | 463/27 |
| 2005/0239542 | A1 * | 10/2005 | Olsen | 463/27 |
| 2005/0282628 | A1 * | 12/2005 | Beatty et al. | 463/27 |
| 2006/0052159 | A1 * | 3/2006 | Cahill et al. | 463/27 |
| 2006/0073887 | A1 * | 4/2006 | Nguyen et al. | 463/27 |
| 2006/0073897 | A1 * | 4/2006 | Englman et al. | 463/42 |
| 2006/0217202 | A1 * | 9/2006 | Burke et al. | 463/42 |
| 2007/0054733 | A1 * | 3/2007 | Baerlocher | 463/27 |
| 2007/0060321 | A1 * | 3/2007 | Vasquez et al. | 463/27 |

* cited by examiner

*Primary Examiner*—Peter DungBa Vo
*Assistant Examiner*—Seng Heng Lim
(74) *Attorney, Agent, or Firm*—Weide & Miller, Ltd.

(57) ABSTRACT

A gaming system includes at least one progressive server and a plurality of gaming machines configured to present wagering games to players for play. The at least one progressive server is configured to generate a plurality of progressive jackpots funded at least partially from funds transactions at the gaming machines. Each gaming machine is configured to present at least a first game play option permitting a player to play for a first of the progressive jackpots and a second game play option permitting a player to play for a second of the progressive jackpots, the player permitted to select from the game play options to play for the opportunity to win the progressive jackpot associated therewith. In one embodiment, the system has a tiered configuration where progressive servers are "layered" and associated with different groups or sets of gaming machines.

14 Claims, 3 Drawing Sheets

TIERED PROGRESSIVE GAMING SYSTEM

FIELD OF THE INVENTION

The present invention relates to gaming systems with progressive or pooled awards.

BACKGROUND OF THE INVENTION

In order to increase the excitement of wager based-gaming, it is desirable to offer large awards. Generally, a particular paytable is provided which defines the awards for particular game outcomes. In order to maintain a particular "hold" on the game, if the award for a particular outcome is increased significantly, the awards for other games must be decreased or there may need to be a lesser number of winning outcomes.

As one technique for providing a large winning, the amount of winnings paid for one or more outcomes may be variable. In a progressive type award configuration, the amount of an award for a particular outcome varies. Generally, a portion of all wagers placed at the gaming machine is set aside to fund a "pool" and a portion of the pool is awarded when the particular game outcome is received. In accordance with this game configuration, large pools or award values may be generated over time as wagered monies accumulate in the pool.

In an enhancement of this technique, a pool may be associated with a plurality of linked gaming machines. In this manner, the wagers of many players at many machines contribute to the growth of the pool. This allows the pool to grow faster and even larger.

These systems, however, have some disadvantages and limitations. First, a particular gaming machine is associated with a single system. Thus, if the progressive pool of a particular group of gaming machines is relatively low, players may be less enticed to play the machines of that group relative to machines of another group or system where the progressive award is higher. Second, each machine of the group or system is linked by one or more communication links to the other machines and/or a host. If those links are broken or interrupted, then the progressive feature is effectively disabled at one or all of the machines, which renders the machines undesirable for play. This can be very costly to the game operator.

An improved progressive gaming system is desired.

SUMMARY OF THE INVENTION

The invention is a progressive gaming system and a method of generating, offering and awarding progressive jackpots or awards to players of gaming machines.

In one embodiment, a gaming system includes at least one progressive server and a plurality of gaming machines configured to present wagering games to players for play. One or more communication links between the plurality of gaming machines and the at least one progressive server permit the gaming machines to send funds transaction information to the at least one progressive server and permit the at least one progressive server to send progressive jackpot information to the gaming machines.

The at least one progressive server is configured to generate a plurality of progressive jackpots funded at least partially from funds transactions at the gaming machines. Each gaming machine is configured to present at least a first game play option permitting a player to play for a first of the progressive jackpots and a second game play option permitting a player to play for a second of the progressive jackpots, the player permitted to select from the game play options to play for the opportunity to win the progressive jackpot associated therewith.

In one embodiment, the system is configured in a "tiered" fashion. In a preferred embodiment, the system includes at least a first and a second low level progressive server, the low level progressive servers each configured to generate a first progressive jackpot. The system also includes at least one high level progressive server configured to generate a second progressive jackpot.

A first group of gaming machines are configured to present one or more games to a player and a second group of gaming machines are configured to present one or more games to a player. At least one first communication link is provided between the first group of gaming machines and the first low level progressive server, at least one second communication link is provided between the second group of gaming machines and the second low level progressive server, and at least one third communication link is provided between the first and second low level progressive servers and the at least one high level progressive server.

The gaming machines of the first group are configured to present at least a first game play option permitting a player to play for the first progressive jackpot generated by the first low level progressive server and a second game play option permitting a player to play for the second progressive jackpot. The gaming machines of the second group are configured to present at least a first game play option permitting a player to play for the first progressive jackpot generated by the second low level progressive server and a second game play option permitting a player to play for the second progressive jackpot.

In a "tiered" configuration, gaming machines associated with a casino may be associated with a local progressive server which offers a local or casino level progressive jackpot. Gaming machines associated with two or more casinos may be associated with a regional progressive server which offers a regional progressive jackpot. Gaming machines associated with the entire system may be associated with a system progressive server which offers a system progressive jackpot.

In one embodiment, communications between the gaming machines and the servers are coded or addressed for recognition by the appropriate progressive server. Communications from the gaming machines are routed upwardly through the "tiers" until recognized by the appropriate progressive server.

Various additional aspects of the invention comprise a method of generating progressive jackpots or awards and an accounting verification method. One aspect of the invention is a progressive gaming system with which is "healing" or "repairing." In one embodiment, in the event of a communication break between lower and higher level progressive servers, the functions of the higher level servers are taken over by the lower level servers, thus allowing the progressive awards generated by those higher level servers to continue to be maintained and offered to the gaming machines.

Further objects, features, and advantages of the present invention over the prior art will become apparent from the detailed description of the drawings which follows, when considered with the attached figures.

DETAILED DESCRIPTION OF THE INVENTION

The invention is a progressive gaming system. In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

In general, the invention is a system including a plurality of gaming machines. The system enables the generation and award of progressive-type jackpots or awards. In one embodiment, the system enables the generation of a plurality of different progressive-type jackpots and players of the gaming machines may make decisions allowing them to play for the different progressive-type jackpots. One aspect of the invention is a tiered progressive system where progressive awards are associated with sets or sub-sets of gaming machines of the system. Additional aspects of the invention comprise a progressive gaming system with error correction, accounting reconciliation and additional features.

Figure 1:
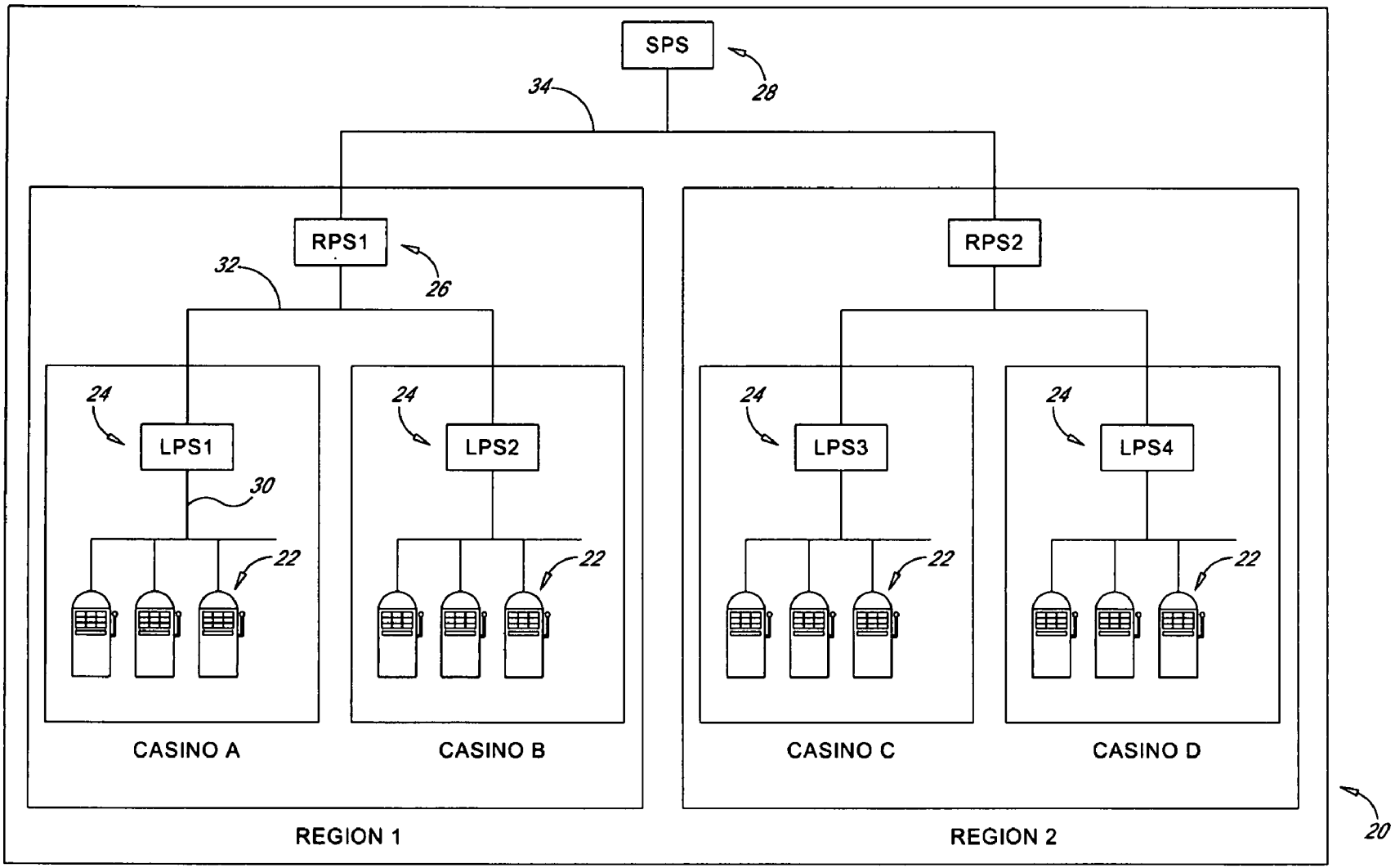
FIG. 1 schematically illustrates a progressive gaming system in accordance with one embodiment of the present invention.

One embodiment of a system of the invention will be described with reference to FIG. 1. FIG. 1 illustrates a progressive system 20. The system 20 includes a plurality of gaming machines or gaming devices 22. The gaming machines 22 may be of a variety of configurations and may offer one or more games. In a preferred embodiment, the gaming machines 22 are configured to offer wagering games. In accordance with these games, a player of the machine 22 places a bet or wager, such as coins, credits or other value, preferably for the opportunity to be awarded winnings. The gaming machines 22 may be "reel"-type slot machines, video "slot" machines, video poker machines or the like, thus including mechanical spinning reels, video displays presenting game information, or having other components. The gaming machines 22 may present a variety of games, including Class II games such as bingo or bingo-based games, and Class III type games such as slot-type games and card games such as poker. Such machines and their configurations are well known to those of skill in the art.

In one embodiment, the system 20 is configured to generate at least two progressive jackpots, and the gaming machines are configured to present play options permitting a player to make a selection to play for one of the progressive jackpots. In this manner, a player of a machine may select a particular game play option and play a game in an attempt to obtain a particular one of the progressive jackpots.

In one embodiment of the system 20, gaming machine funds transactions are used to fund the progressive jackpots. Preferably, different numbers of gaming machines are associated with the progressive jackpots, whereby the jackpots may be funded at different rates.

In a preferred embodiment of the invention, the system 20 is configured to implement at least one first level progressive and at least one second level progressive. In a preferred embodiment, these progressives are implemented by at least a first level progressive server or controller and at least one second level progressive server or controller, those servers or controllers associated with different groups or sets of gaming machines.

In the embodiment illustrated in FIG. 1, a first or low level progressive server comprises a local progressive server 24. At least one, and preferably a plurality of, gaming machines 22 are associated with each local progressive server 24. A number of local progressive servers 24 may be provided, each preferably associated with one or more distinct sets of gaming machines 22. In the embodiment illustrated, for example, one or more gaming machines 22 of a particular casino may be associated with a local progressive server 24. There might be multiple local progressive servers 24 associated with a variety of different gaming machines or groups of gaming machines. For example, particular groups of gaming machines 22 of a single casino or property might be associated with different local progressive servers 24.

The term "local" is used for identification purposes only, it being appreciated that the local progressive server 24 need not be located "locally" in the sense that the server is in close physical proximity to the particular associated machine or machines. On the other hand, when the system 20 is configured as illustrated, it is likely that the local progressive servers 24 will be in relatively close proximity to the gaming machines 22, such as at the particular casino or other property or location where the machines are located.

In this same embodiment, a second level progressive server comprises a regional progressive server 26. A plurality of gaming machines 22 are associated with each regional progressive server 26. Preferably, the plurality of gaming machines 22 associated with each regional progressive server 26 comprise different sets of gaming machines than are associated with any particular local progressive server 24. Most preferably, a greater number of gaming machines 22 are associated with each regional progressive server 26 than are associated with the local progressive servers 24. For example, referring to FIG. 1, the gaming machines 22 associated with two or more local progressive servers 24 may be associated with a single regional progressive server 26. In a casino environment, the gaming machines of a plurality of local casinos may be associated with a single regional progressive server 26. For example, referring to FIG. 1, various of the gaming machines 22 of a first casino A and a second casino B may be associated with a single regional progressive server 26.

Of course, a variety of sets of gaming machines 22 may be associated with a regional progressive server 26. The term "regional" is not meant to have a "geographic" limitation, in that gaming machines 22 which are separated by a great physical distance may be associated with a common regional progressive server 26, and instead the term "regional" is simply used to aid in distinguishing from "local" in the sense that different combinations of machines are preferably associated with these servers.

In a preferred embodiment, one or more additional progressive jackpots may be provided. For example, in the system configuration illustrated in FIG. 1, one or more additional progressive jackpots may be implement via a system progressive server 28. A plurality of gaming machines 22 are associated with the system progressive server 28. Preferably, a greater number of gaming machines 22 are associated with the system progressive server 28 than are associated with the region progressive servers 26. For example, referring to FIG. 1, the gaming machines 22 associated with all of the local progressive servers 24 may be associated with a single system progressive server 26.

Of course, a variety of sets or groups of gaming machines 22 may be associated with the system progressive server 28. The term "system" is again not meant to have a geographic limitations but is instead used to simply aid in distinguishing that progressive server from the others.

A particular example system is illustrated in FIG. 1. It will be appreciated that there be any number of local, progressive and/or system servers 24,26,28. These servers may be physically located in any number of locations. The system 20 may also have greater or lesser "levels" of servers or numbers of servers than illustrated.

In a preferred embodiment, the gaming machines and the progressive servers are linked by one or more communication links. As detailed below, these communication links permit data to be transmitted between the various system components for implementing one or more progressive jackpots or awards. In one embodiment, as illustrated in FIG. 1, each gaming machine 22 is in communication with its associated local progressive server 24 via one or more communication links 30. Each local progressive server 24 is in communication with its associated regional progressive server 26 via one or more communication links 32. Each regional progressive server 26 is in communication with its associated system progressive server 30 via one or more communication links 34.

In this manner, the system 20 is configured as a "tiered" or "pyramid" type system. In particular, communications between the gaming machines 22 (at the lowest level) and the regional and system progressive servers 26,28 is through intermediate "levels," i.e. through the local progressive servers 24, and so on. In this configuration, each machine 22 communicates directly with the lowest "tier" server, but communicates with higher "tier" servers via the communication link between the lower and higher tier servers, rather than via a direct link to those higher tier servers.

The communication links, including the protocol used for communication and the software and/or hardware for implementing the links, may vary. For example, the communication links may be wired or wireless, and may implement a variety of protocols, and the links may be implemented using a variety of hardware. For example, if the link is a wireless link, the protocol/architecture may be Bluetooth or IEEE 802.xx. For wired links, the protocol/architecture may be RS-232, IEEE-1394 (Firewire™), TCP/IP or Ethernet.

The progressive servers 24,26,28 may have a variety of configurations. Preferably, the servers 24,26,28 are configured to perform or implement the various functions described herein. In one embodiment, the servers are computing devices including hardware and/or software. The servers may be one or more devices.

In accordance with the invention, the gaming machines 22 provide game information to the progressive servers. This information is used by the servers to generate or create progressive pools from which progressive jackpots or awards may be awarded based upon a variety of criteria, such as receipt of a particular game winning outcome at one of the gaming machines.

Figure 2:
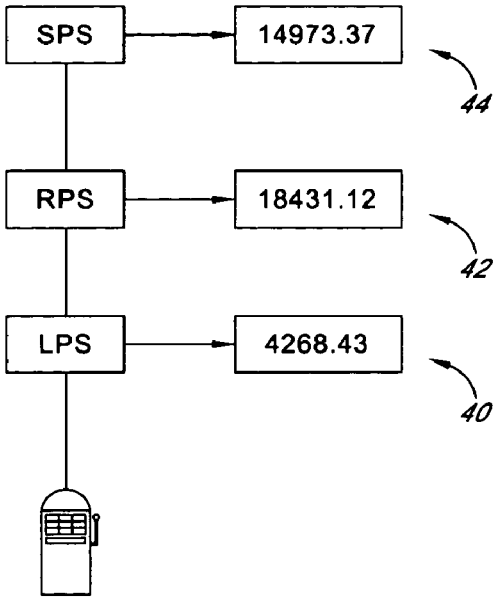
FIG. 2 illustrates a portion of the system illustrated in FIG. 1 with progressive jackpots available for play at one of the gaming machines of the system.

In one embodiment, as illustrated in FIG. 2, each local progressive server 24 may implement a first, local progressive jackpot 40. Each regional progressive server 24 may implement a second, regional progressive jackpot 42. The one or more system progressive servers 26 may implement a third, system progressive jackpot 46. In one embodiment, each progressive jackpot 40,42,44 is represented as a numerical value.

As is known in the art, progressive pools may have two components: a seed or base component and an award component. Funds are associated with the progressive pool. A portion of this pool is offered as a progressive jackpot. As the amount of funds associated with the pool grows, the progressive jackpot grows. If the progressive jackpot is awarded, such as upon receipt by a player of a gaming machine of a particular winning result, the progressive jackpot is reset. Normally, the jackpot is not reset to zero, but instead a portion of the base or seed money is used to seed the progressive jackpot to a minimum amount. Of course, other progressive jackpot configurations can be implemented by the system of the present invention.

In one embodiment, a portion of wagers placed at the gaming machines 22 for play of one or more games are used to fund the progressive pools. Thus, the gaming machines 22 are configured to transmit funds information, and more preferably, wager information, for use by the progressive servers 24,26,28 in forming the pools.

Funds are "assigned" to a particular pool or jackpot for funding and growing that pool or jackpot. In a preferred embodiment, funds are associated with the pool or jackpot which is associated with a particular player-selected game play option. In particular, the players of the gaming machines are preferably presented with at least a first game play option and a second game play option. The first game play option provides the player the opportunity to play for a particular one of the progressive jackpots. The second game play option provides the player the opportunity to play for another of the progressive jackpots.

The game play options may have a variety of forms. For example, a player may be permitted to play a particular game and select a progressive jackpot from among the various progressive jackpots, for which they wish to play. Alternatively, the progressive jackpots may be tied to or associated with particular game play options, such as particular games or version of games. When a player makes a game selection, the progressive jackpot may thus already be associated therewith.

In the system 20 described above, a gaming machine 22 is only linked to particular progressive servers. For example, in the system 20 illustrated in FIG. 1, the gaming machines 22 of casino A are associated with or linked to the local progressive server 24 of that casino, but are not linked to or associated with the local progressive server 24 of casino B. Thus, the gaming machines 22 of casino A can only offer players the opportunity to play for the progressive jackpots associated with local progressive server 1 of casino A (LPS1), regional progressive server 1 (RPS1), and the system progressive server (SPS).

It will be appreciated that in the system described above, more gaming machines 22 are associated with the higher level progressive servers than the lower level progressive servers. Thus, the players of a greater number of gaming machines 22 have the opportunity to select and play for progressive jackpots offered by the higher level progressive servers than those offered by the lower level progressive servers. As such, the higher level progressive jackpots are more likely, over the long term, to grow faster. This does not mean, however, that the value of the progressive jackpots associated with the higher level progressive servers will always be higher than those associated with the lower level progressive servers. For example, if a progressive jackpot associated with a regional progressive server has recently been won, that progressive jackpot may be reset to a relatively low level. At the same time, the one or more progressive jackpots associated with lower, local level progressive servers associated with that regional progressive server, may be high. Further, the rate of growth of those lower level progressive jackpots may be higher than the rate of growth of the higher level jackpot as great numbers of players elect to play for the higher value progressive jackpots offered by those lower level progressive servers.

FIG. 2 illustrates one example of particular progressive jackpot values for the local, regional and system progressive servers to which a particular gaming machine 22 is linked. These values have been selected arbitrarily and could be any amount. This figure illustrates, however, an aspect of the invention wherein a player may consider the value of the progressive jackpots. The player's review of this information may be used by the player when making a game play selection.

As indicated, in a preferred embodiment, funds wagered at the gaming machines are associated with, such as by an allocation procedure, the one or more progressive pools or jackpots. Preferably, a portion of wagers placed to play a game for the opportunity to win a particular progressive jackpot are associated with that progressive jackpot or pool. For example, if the player has the option of selecting a first game option to play for a local progressive jackpot or a second game option to play for a regional progressive jackpot, and the player selects the first option and places a wager to play the game, then the funds transaction is associated with the local progressive jackpot or pool. In one embodiment, this results in a portion of the player's wager being allocated to that progressive jackpot.

In order to associate funds with the progressive pools or jackpots, in a preferred embodiment, the gaming machines are configured to transmit pool or jackpot identification information with funds transaction information in order to associate the funds with the correct jackpot or pool.

Figure 3:
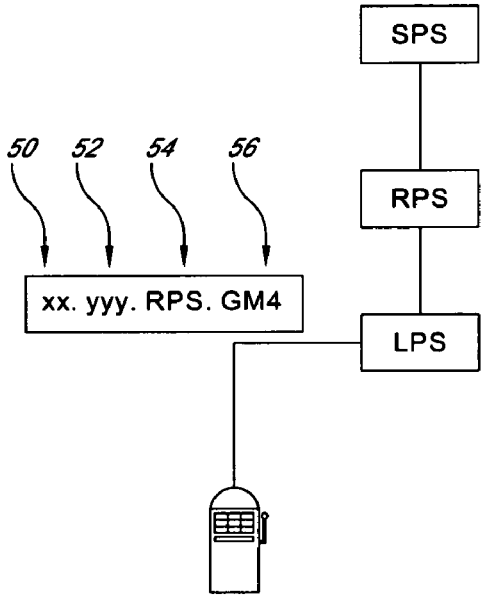
FIG. 3 illustrates a communication configuration of a gaming machine of the system illustrated in FIG. 1.

Referring to FIG. 3, in one embodiment the gaming machine transmits funds or funds transaction information. As illustrated, the funds information preferably includes funds value information 50, gaming machine identification information 52, and progressive server or pool identification information 54. In one embodiment, the funds information 50 may comprise a numerical funds value. This value may comprise the amount of the wager, or the portion of the wager which is being assigned to the fund, or may include both or other funds information. The identification information 52 may comprise a gaming machine ID or other information which identifies the gaming machines which transmitted the funds information. The pool identification information 54 preferably comprises a routing designator which is, in the preferred embodiment, used to route the information to the correct server and associate the funds with the correct progressive pool.

In one example, as illustrated in FIG. 2, the pool identification information 54 may comprise a progressive server identifier, such as the designator .RPS. This designator may designate that the funds information is to be routed to the regional progressive server with which the gaming machine is associated, and designates the identified funds are to be allocated to that progressive pool or jackpot.

The fund information may also include other information. For example, referring to FIG. 3, the fund information may include game identification information 56. In one embodiment of the invention, the progressive servers may generate progressive jackpots for different games. For example, a local progressive server may generate a progressive jackpot for a first game, game A, and another progressive jackpot for a second game, game B. In this configuration, the local progressive server must be informed which of those pools or jackpots with which to associate the funds. In one embodiment, this is accomplished by use of a game identifier. In other embodiments, other types of identifying information might be used. For example, each progressive pool might have a particular ID which thus identifies that the pool is associated with a particular game and a particular server.

In the system 20 of the invention where the progressive servers are configured in "tiered" fashion, the funds information is routed from the gaming machine 22 upwardly through the communication network or tree. The information is routed first to the lowest level server, such as the local progressive server 24. If the information is identified for association with the local progressive server, such as by including the particular pool identification information for that server. If not, then the lowest level server preferably routes the information to the next higher level server, such as the regional progressive server with which the local progressive server is associated.

Figure 5:
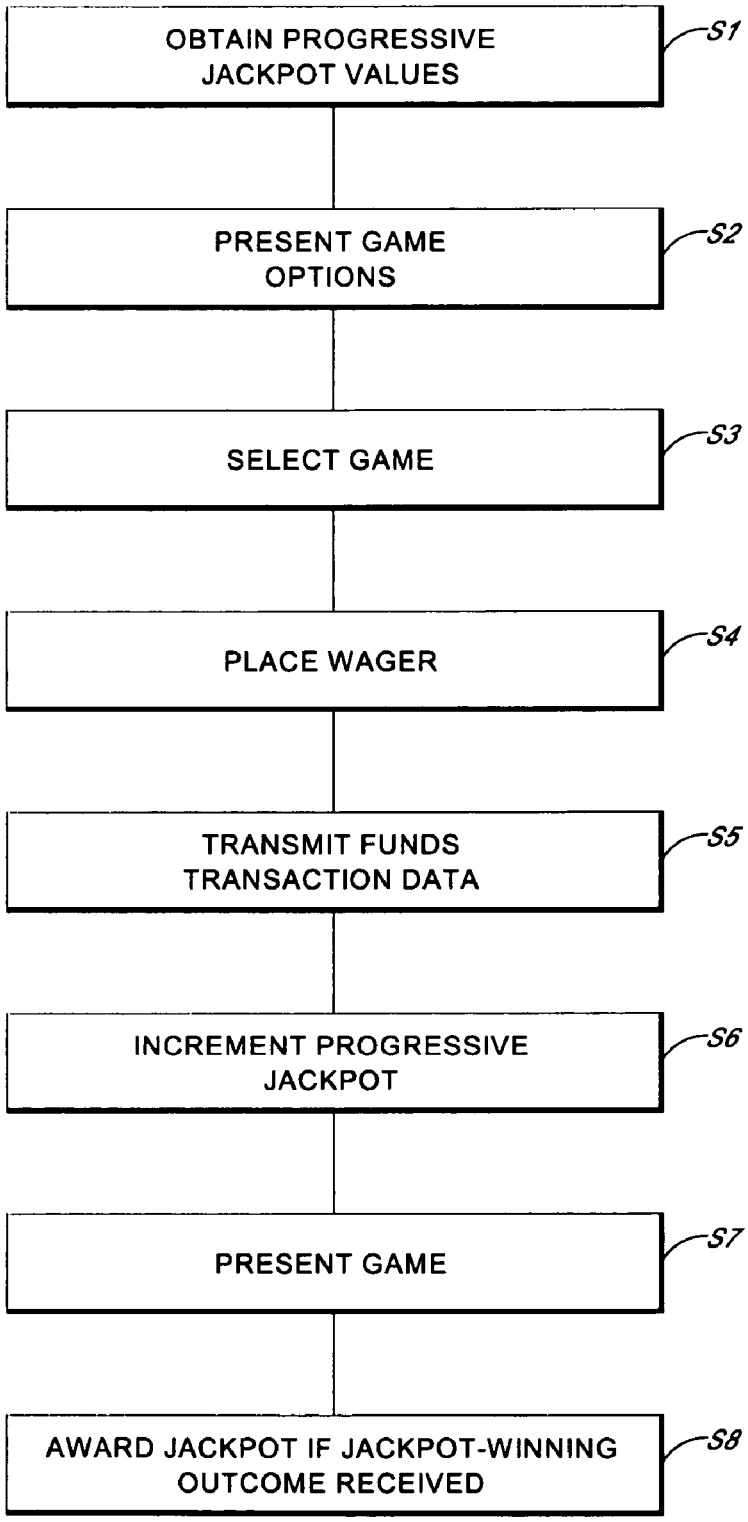
FIG. 5 illustrates in flow-chart form a method of the invention.

One method of operation of a system of the invention will now be described with reference to FIG. 5. This method is described primarily in relation to acts or actions occurring at one of the gaming machines. In a step S1, the gaming machine obtains progressive jackpot values. In one embodiment, the progressive servers of the system continually (or on a frequent interval) broadcast the progressive jackpot values which may be won by play of certain games. This information may be generally transmitted over the communication links of the system. In one embodiment of the system, the gaming machines may be configured to screen the information to determine which progressive jackpot information is relevant to the games which that machines offers. In another embodiment, the progressive servers maybe configured to route the progressive jackpot information to the particular gaming machines offering games with which the progressive jackpot is associated. Regardless of the implementation, this step preferably results in each gaming machine being provided with progressive jackpot information.

In a step S2, the gaming machine preferably presents the plurality of game options associated with at least two progressive jackpots. Preferably, the values of the various progressive jackpots which the player of the gaming machine may play for are displayed to the player. In this manner, the player may evaluate the progressive jackpots as part of making a decision regarding which game option to select. The progressive jackpot information is preferably graphically illustrated, such as in a meter fashion (as the jackpot values will generally be changing over time).

In a step S3, the player preferably selects a game to play. This may comprise the step of selecting a game option from a list of game options. Such a selection may be accomplished with a touch-selection from an on-screen menu or by other means, such as buttons or the like.

In a step S4, the player preferably places a wager to play the selected game. The wager may be placed from credit which the player has provided to the gaming machine, such as by inserting coins, bills, value tickets or vouchers, a player card or other means.

In a step S5, the gaming machine transmits funds information. As indicated above, each gaming machine is preferably configured to track financial transactions, such as wagers placed. The gaming machine generates information corresponding to these transactions. Preferably, the gaming machines transmit the financial information to the progressive servers for storage and use in accounting verification, and also to increment or increase progressive pools/jackpots. As detailed above, the financial transaction information may be coded to identify the particular game, progressive pool or jackpot and/or particular progressive server to which the financial transaction information is to correspond. Once the player has indicate the particular game to be played, then the financial transaction information can be coded to identify the associated server and/or progressive pool or jackpot to which the transaction corresponds.

In a step S6, the information is received by the appropriate progressive server and funds are allocated to the progressive pool or jackpot. As indicated, in a preferred embodiment, the funds transaction information may be transmitted upwardly through the system, including being routed from lower to higher level progressive servers, until it reaches the intended progressive server. Preferably, that server stores the transaction information and allocates the appropriate funds corresponding to the player's wager to the progressive pool/jackpot which corresponds to the game option select by the player. Of course, when the progressive servers are continually updating the progressive jackpot values and transmitting those values, the value of the progressive jackpot increases and that increased value is preferably reflected at the gaming machines.

In a step S7, the game is preferably presented to the player. As indicated above, the gaming machine may be configured to present a wide variety of games. Those games may be slot-type games, video-type games, may include bonuses and otherwise be of a wide variety of types. The presentation of the game may include one or more player inputs (such as an indication of cards to be held, as in the game of video poker). Game data used to present the game may be generated at the gaming machine or may be generated remotely and be transmitted to the machine.

In a step S8, the outcome of the game is determined. If the outcome of the game is a progressive jackpot winning result, then the gaming machine preferably transmits information of that fact/result to the progressive server. The server then confirms the winning result and, if verified, awards the progressive jackpot to the player. Of course, the result of the game may be a non-winning outcome, or it may be a winning outcome which is not an outcome entitling the player to the progressive jackpot. In the latter case, the player may be awarded other winnings.

When the jackpot is awarded, financial data, such as a number of credits corresponding to the progressive jackpot value, may be transmitted to the gaming machine. The gaming machine may then indicate the award of the jackpot, such as by crediting the credits to the player.

In one embodiment, the progressive servers store gaming machine meter data, and thus preferably include or associated with one or more data storage devices (electronic memory such as RAM, ROM, a hard drive, flash memory or the like). As is well known to those of skill in the art, each gaming machine preferably includes one or more electromechanical meters. These meters track financial transactions at the gaming machine, such as the value of wagers placed, monies input and dispensed and the like. In a preferred embodiment, the gaming machines transmit meter data to the progressive servers. This information is then used to generate and/or increment the progressive pools or jackpots, and is stored for various purposes, such as accounting verification, error correction and the like, as detailed below.

Figure 4:
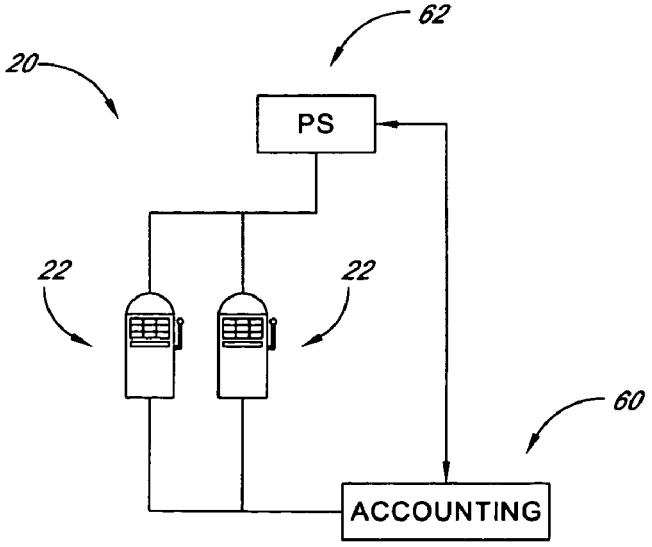
FIG. 4 illustrates another progressive system in accordance with the invention, the system including an accounting verification link.

One aspect of the invention is an accounting verification system. This system preferably permits verification of financial information. Referring to FIG. 4, the gaming machines 22 of the system 20 are preferably configured to send accounting information to an accounting server 60. This accounting information 60 preferably comprises meter information, such as information regarding the input of monies, payment of monies, wagers and similar financial events occurring at the gaming machine. In this manner, the gaming machine 22 operator can monitor gaming machine activity. This activity information may include play and profit activity for the gaming machine. The operator can also use the information to verify that monies taken from the machine (such as when the coin hopper or cash box are emptied), the removed funds match the funds which are indicated to have been provided to and retained by the gaming machine. This aids the operator in ensuring that monies are not being stolen from the machine.

As described above, the gaming machines 22 of the system 20 are configured to transmit meter data to the progressive server(s) 62. These servers 62 may comprise the local, regional and/or system progressive servers described above. These servers 62 also maintain information regarding progressive pool funds and jackpots paid.

In accordance with the present invention, the system 20 is configured so that the accounting server 60 and the one or more progressive servers 62 may communicate. Preferably, the accounting server 60 is permitted to "audit" information at the progressive servers 62 for use in reconciling financial transactions on the system. For example, the value of financial transactions as reported by a particular gaming machine 22 directly to the accounting server 60 should match the value of financial transactions by that machine as monitored by the progressive server(s) 62, including funds associated with the progressive pool(s) and progressive jackpots paid to a particular machine.

Another aspect of the invention is a gaming system, and more particularly a progressive gaming system, which has self-repairing/error correcting features.

In a system such as that illustrated in FIG. 1, various of the communication links may be broken from time to time. Most commonly, the links which will be broken are those between the local and regional progressive servers 24,26, and the regional and system progressive servers 26,28, mainly for the reason that these links are generally external to a single casino, when considering the specific configuration illustrated.

In the event of a break of these second or third communication links 32,34, the progressive server which is in the tier immediately below the break is configured to take over the progressive pool/jackpot management and generation duties of the higher progressive server. For example, in the event of a break in the third communication link 34 between a regional progressive server 26 and the system progressive server 28, then the regional progressive server 26 will no longer be able to transmit funds information intended for the system progressive server 28 which is forwarded to it from the various local progressive servers 24.

As indicated above, in a preferred embodiment, each progressive server is preferably configured to transmit progressive jackpot information. This information is, of course, routed through the communication links of the system 20 and thus reaches both the gaming machines 22 and the various other progressive servers. In a preferred embodiment, each progressive server stores the progressive jackpot value or data for the progressive servers which are above it in the system.

In this configuration, the regional progressive server 26 stores the last progressive jackpot value for the progressive offered by the system progressive server 28. Once a communication break is detected, the regional progressive server 26 may begin to perform the duties of the system progressive server 28 by incrementing the system progressive jackpot by funds amounts associated with the funds transaction data which is intended for the system progressive server 28 and associated progressive jackpot.

Once the communication link is repaired or re-established, the regional progressive server 26 may transmit the new jackpot value, representing the additional funds incremented to the jackpot added to the original jackpot value, to the system progressive server 28. The system progressive server 28 may then reset its jackpot value information and start incrementing the value.

Of course, this aspect of the invention maybe applied to systems configured other than as illustrated in FIG. 1 and to other portions of that particular system. For example, the local progressive servers of the system 20 illustrated in FIG. 1 may take over the functions of their associated regional progressive server in the event of a break of a second communications link 32.

In another embodiment the invention, in the event of a communication break, the one or more progressive servers below the break may set the progressive jackpot values for the jackpots generated by the higher progressive server to a base value, rather than the last known value. This feature may be used to avoid the potential risk that a particular progressive jackpot might be awarded twice. Assume, for example, a break in a third communication link 34 which prevents the regional progressive servers 26 from communicating with the system progressive server 28. In that event, if both regional progressive servers 26 set the system progressive jackpot to the same immediately prior value, and then a winning result is received by a gaming machine 22 associated with each of those regional progressive servers 26, the system progressive jackpot would be awarded twice, rather than being awarded once and then being reset before being won the second time.

Thus, in one embodiment of the invention, the one or more progressive jackpots for higher level servers may be set to a base amount by the lower tier server in the event of a communication break. For example, in the above-described example, if each regional progressive server set the system progressive to one-half the original value, then if each regional progressive server awarded the system progressive jackpot, the total value of the two awards would be no more than the original value of the jackpot as generated by the system progressive server.

Various of the features and principals of the present invention may be applied to other methods, systems and environments.

The system and method of the invention has numerous benefits. A substantial advantage of the system is that players of gaming machines are presented with multiple progressive jackpots which they may play to win. Players may strategize in an attempt to improve their chance to win. For example, one player may believe that they have a higher likelihood of winning a local progressive because the number of machines which are associated with that progressive jackpot is small. Another player might simply elect to play for the largest progressive jackpot, and thus desire to consider all jackpot values and determine the highest one. In any event, the invention results in a high level of enticement for player play of the games associated with the system.

In one embodiment, the system may include one or more information servers. The progressive servers may report the progressive jackpot values to the information server. The information server may have a communication link to the Internet, permitting players to check the value of progressive jackpots from work, home or other locations remote from the gaming machines of the system. Players may thus monitor the jackpots remotely.

Another advantage of the invention is that a break in remote communications links does not disable the progressive jackpot feature. Existing wide area progressive systems rely upon communications between machines and a single remote server. When the communications link is broken, the progressive aspect of game play is completely disabled, since the machines are no longer in communication with the server. In accordance with the present invention, the "tiered" configuration of the progressive servers permits lower level servers to take over the functions of higher level servers in the event of communication breaks.

Yet another advantage of the invention is that the gaming machines are configured to transmit funds information upwardly through the "tier." This ensures that one or more servers are exposed to the information and store the funds information. The funds information can then be used in independent accounting verification.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A progressive gaming system comprising:

a plurality of gaming machines configured to present one or more games to plurality of players;

at least one first progressive server, said at least one first progressive server configured to present for play a first progressive jackpot award;

at least one primary communication link between said plurality of gaming machines and at least one first progressive server, whereby said plurality of gaming machines are associated with at least one first progressive server to receive first progressive jackpot award information there from;

at least one second progressive server configured to present for play a second progressive jackpot award;

at least one secondary communication link between said second progressive server and at least one first progressive server, whereby said at least one first progressive server is configured as a manager to receive information regarding said second progressive jackpot award and transmit said second progressive jackpot award to said plurality of gaming machines;

said plurality of gaming machines configured to display at least said first progressive jackpot award and said second progressive jackpot award and accept a player jackpot award selection indicating which one of said progressive jackpot awards said player wishes to play for;

said plurality of gaming machines configured to present a game permitting said player to play for said one of said first and second progressive jackpot awards corresponding to said play jackpot award selection but not permitting said player to play for any other of said progressive jackpot award;

each of said plurality of gaming machines configured to generate and transmit funds transaction information there from for receipt by the appropriate server or servers pertaining to play for said first or second progressive jackpot awards; and wherein said at least one first progressive server is configured to receive said funds transaction information from said plurality of gaming machines and, if said funds transaction information is for use by said first progressive server, utilize said funds transaction information in the play for said first progressive jackpot award and if said funds transaction information is for use by said second progressive server, to transmit said funds information transaction information on to said second progressive server.

2. The progressive gaming system in accordance with claim 1 wherein said plurality of gaming machines can communicate with a plurality of first progressive servers via one or more primary communication links and one or more of said first progressive servers communicate with at least one second progressive server via at least one secondary communication link.

3. The progressive gaming system in accordance with claim 1 wherein in the event of an interruption in communications in the secondary communication link, said one or more first progressive servers receive and store second progressive jackpot award information, said first progressive servers taking over the functions of the second progressive server relative to play for the second jackpot award.

4. The progressive gaming system in accordance with claim 3 wherein said interruption is an unintentional break in the secondary communication link.

5. The progressive gaming system in accordance with claim 3 wherein each first progressive server stores information regarding said second progressive jackpot award from each second progressive server associated therewith.

6. The progressive gaming system in accordance with claim 1 wherein said funds transaction information comprises gaming machine meter data.

7. The progressive gaming system in accordance with claim 1 further comprising at least one accounting server, said accounting server in communication with at least one of said first or second progressive servers.

8. The progressive gaming system in accordance with claim 1 further comprising at least one tertiary or higher progressive server configured to present for play at least one third or higher progressive jackpot award, one or more communication links between such tertiary or higher progressive servers and at least one second progressive server, said tertiary or higher progressive servers configured to exchange information with said first and second progressive servers and gaming machines as said first and second progressive servers.

9. The progressive gaming system in accordance with claim 1 further comprising at least one tertiary progressive server, at least one third communication link between at least one of said tertiary progressive servers and at least one second progressive server, wherein said tertiary progressive servers are configured to present for play a third progressive jackpot award and wherein said second and first progressive servers are configured to transmit said third progressive jackpot award to said plurality of gaming machines and wherein said funds transaction information if coded to said tertiary progressive server is routed via said first and second progressive servers to said tertiary progressive server.

10. The progressive gaming system in accordance with claim 1 wherein said at least one first progressive server comprises a server serving a single gaming location and said at least one second progressive server comprises a regional server serving more than one gaming location.

11. The progressive gaming system in accordance with claim 1 comprising a plurality of first progressive servers, said plurality of gaming machines linked to at least one of said first progressive servers via at least one primary communication link and wherein at least one of said first progressive servers are linked to a second progressive server.

12. The progressive gaming system in accordance with claim 1 wherein said plurality of gaming machines are configured to present a first bingo game having a first progressive jackpot award for play and a second bingo game having a second progressive jackpot award for play.

13. The progressive gaming system in accordance with claim 1 wherein said system is configured to display current jackpot levels of said first and second progressive jackpot awards to said players of said gaming machines and said gaming machines are configured to receive input from a player thereof of a selection to play at least one game having said first game play configuration or at least one game having said second game play configuration.

14. The progressive gaming system in accordance with claim 8 wherein said player jackpot award selection indicates one of said at least one third or higher progressive jackpot award permitting said player to play for said one of said at least one third or higher progressive jackpot award indicated by said player jackpot award selection but not permitting said player to play for any other of said progressive jackpot awards.

* * * * *